US006237890B1

(12) United States Patent
Gates

(10) Patent No.: US 6,237,890 B1
(45) Date of Patent: May 29, 2001

(54) SUPPORT APPARATUS OR A CONCRETE FORM SYSTEM

(75) Inventor: H. Gordon Gates, Denver, CO (US)

(73) Assignee: Gates & Sons, Inc., Denver, CO (US)

( * ) Notice: Subject to any disclaimer, the term of this patent is extended or adjusted under 35 U.S.C. 154(b) by 0 days.

(21) Appl. No.: 09/229,201

(22) Filed: Jan. 13, 1999

(51) Int. Cl.[7] ..... E04G 17/00
(52) U.S. Cl. ..... 249/219.2; 249/219.1
(58) Field of Search ..... 249/219.1, 219.2, 249/40, 190, 213, 46

(56) References Cited

U.S. PATENT DOCUMENTS

| | | | |
|---|---|---|---|
| 2,017,553 | * 10/1935 | Troiel | 249/219.2 |
| 3,908,956 | 9/1975 | Gates . | |
| 4,158,452 | 6/1979 | Gates . | |
| 4,304,388 | 12/1981 | Gates . | |
| 4,899,978 | 2/1990 | Gates . | |
| 5,110,083 | 5/1992 | Page . | |

OTHER PUBLICATIONS

Gates & Sons, Inc., "Gates Cam–Lock Forming System," Dec. 1993, Gates & Sons, Inc., Denver, Colorado, USA.

* cited by examiner

*Primary Examiner*—Michael Safavi
(74) *Attorney, Agent, or Firm*—Dorr, Carson, Sloan & Birney, P.C.

(57) ABSTRACT

A support apparatus with a tie lock tool and a clamp for a concrete form system. Opposing form panels are held in fixed relation to one another with at least one form tie having either a loop head or button head extending between the form panels. A tie lock tool engages a waler positioned on the form panel. The tie lock tool has a form tie opening, configured to receive the head. A lock member, of the tie lock tool, has two claws and is rotatable between an unlocked and a locked position. The first claw has an extension beyond the second claw for abutting the head extended through the form tie opening when the lock member is unlocked. When the lock member is locked, the head is firmly held, thus securing the form tie to the tie lock tool, the waler and the form panel. A strong back of variable depth is secured to the tie lock tool with an adjustable clamp. Two arms of the clamp are connected to the tie lock tool, and an adjustable clamp member engages and tightens against the variable depth strong back to secure the strong back to the tie lock tool and support the concrete form system.

29 Claims, 10 Drawing Sheets

5
20
55
265
440
50
400
400
10
35
30
150
440
265
30
31
10
32
20
50
57
400
400
35
440

Fig. 3(a)
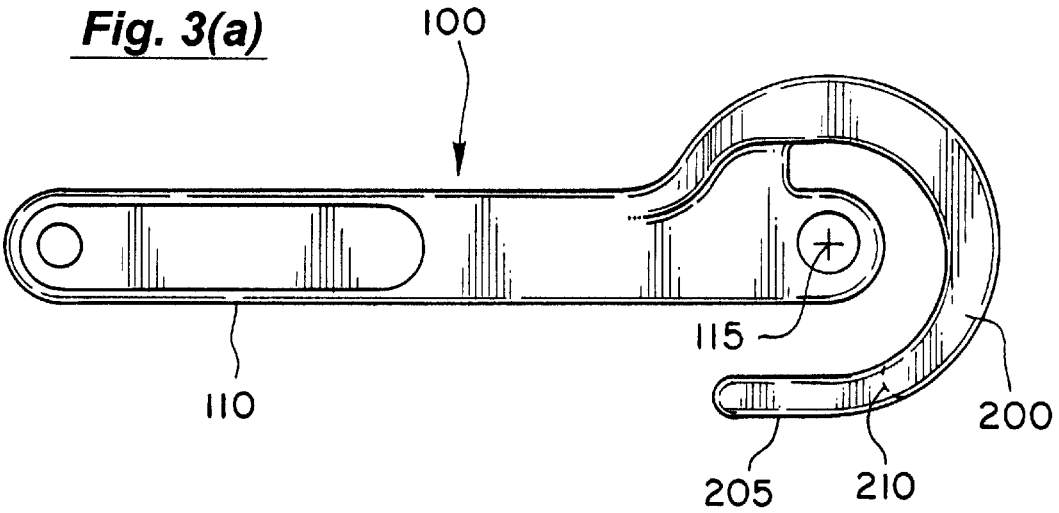
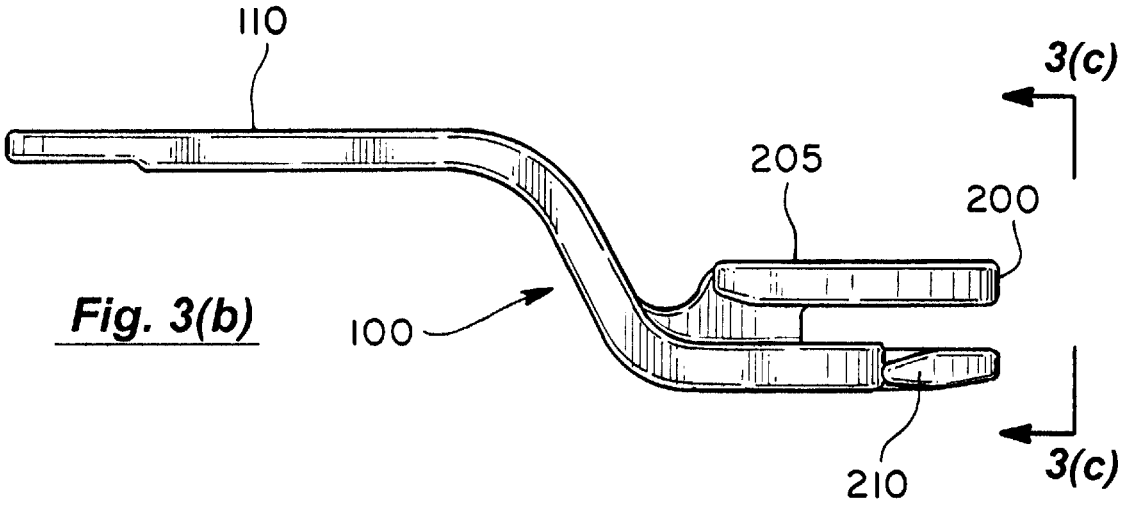
Fig. 3(b)
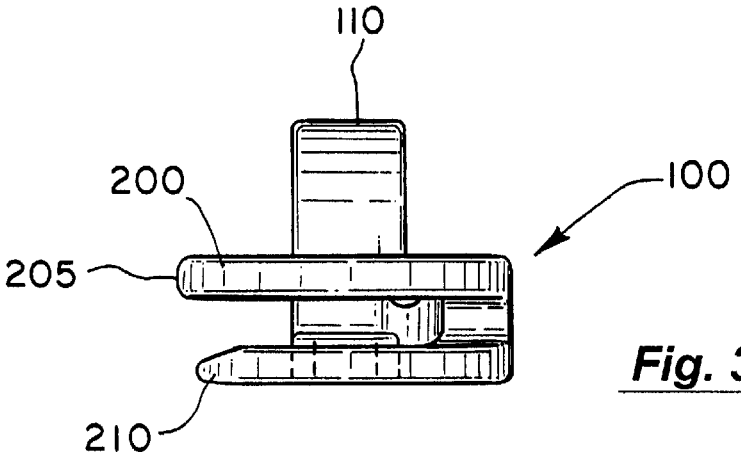
Fig. 3(c)

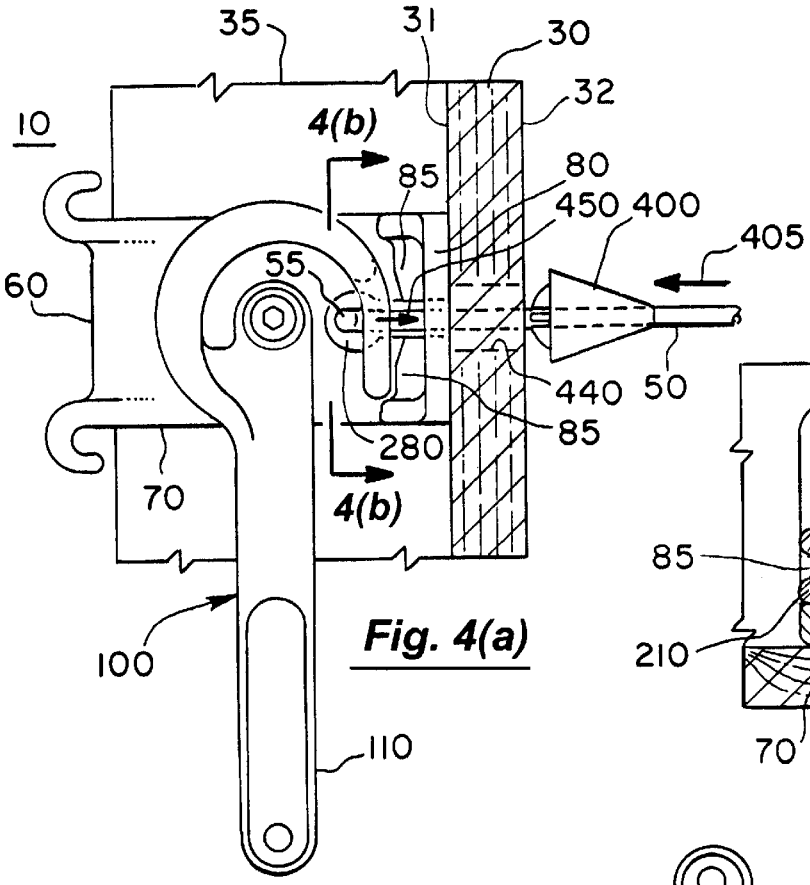
Fig. 4(a)
Fig. 4(b)
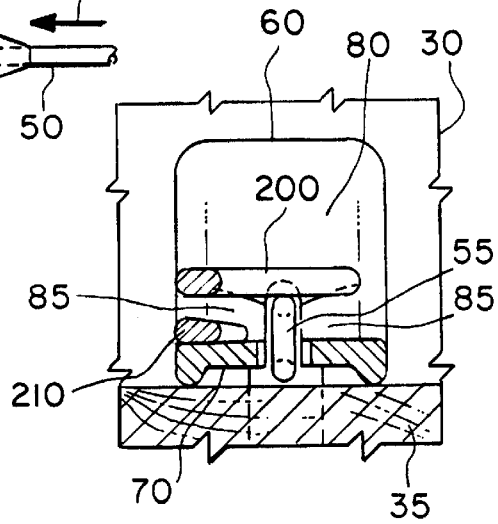
Fig. 4(c)
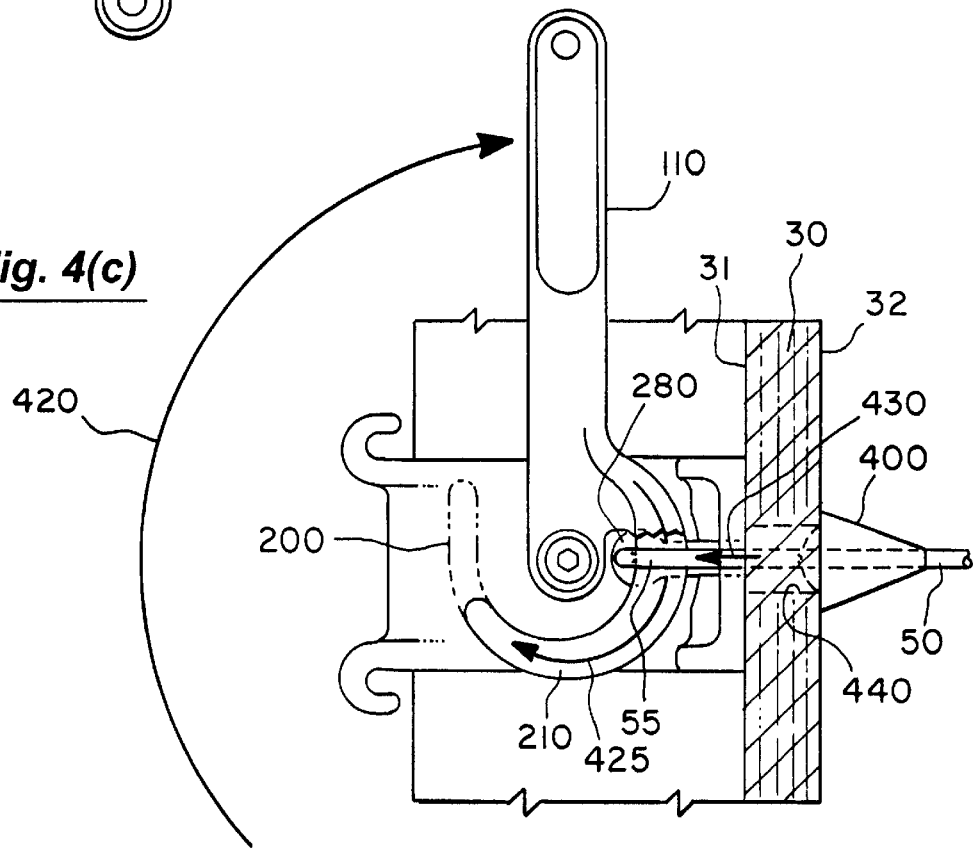

SUPPORT APPARATUS OR A CONCRETE FORM SYSTEM

BACKGROUND OF THE INVENTION

1. Field of the Invention

The present invention relates generally to the field of concrete form systems. More specifically, the present invention discloses a support apparatus including a tie lock tool and a clamp for use with concrete form panels.

2. Statement of the Problem

Concrete form systems have been used for many years for concrete wall construction. In these systems, form panels are arranged opposing one another to provide a space into which concrete is poured to form the wall. Form ties, extending between and secured to the form panels, maintain a fixed distance between the form panels. After the form system is erected, concrete is poured between the form panels and allowed to harden, after which the form panels are removed.

The form ties are often secured to the form panels using a tie lock tool. Conventional tie lock tools, such as that. disclosed in co-owned U.S. Pat. No. 4,304,388, have a lock member with a single claw that grasps a head of the form tie. Aligning the head of the form tie to fit onto the single claw of the conventional tie lock tool can be labor intensive. For instance, at one time the head is too low to catch on the single claw, and another time the head is too high to catch on the single claw. Therefore, a worker must align the head with the claw while rotating the lock member to the locked position. Often, this process requires the assistance of a second worker. Therefore, a need exists to provide a tie lock tool that aligns the head with the claw.

In addition, a single claw can only grasp a loop head or a head having a hole formed therein. However, form ties having different head styles are available, such as button heads. U.S. Pat. No. 4,304,388 discloses a tie lock tool having two claws for grasping a button head, but the head must still be aligned to fit between the two claws. Therefore, a need also exists to provide a tie lock tool that can be used with form ties having different types of heads, for example, a button head or a loop head.

The lock member of the conventional tie lock tool is rotatably attached using a rivet. When concrete is poured between the form panels, substantial pressure is placed on the form ties, causing the claw of the tie lock tool to bear a substantial load. Therefore, a need exists to reduce this load on the claw.

Clamps are often used to secure a strong back (conventionally 2×4 lumber) to the form panels to support the concrete form system. Conventional clamps, such as that disclosed in co-owned U.S. Pat. No. 4,304,388, have a 3-gauge wire yoke that attaches to the tie lock tool. However, these clamps only provide a working load of 1,000 lbs.

In some circumstances, it is be desirable to increase the total load-bearing capacity above 1,000 lbs, for example, when longer or wider walls are poured in a concrete form system. Therefore, a need exists to provide a support apparatus that can handle such increased loads by increasing the strength of strong back clamps.

Conventional clamps are made to secure a conventional 2×4 lumber (1½ inch wide×3½ inch deep) strong back. However, 2×4 lumber is not always made to industry standards, and in some cases, 2×4 lumber sizes can vary from that of a conventional 2×4. Therefore, when the depth of the strong back is too small, the conventional clamp only loosely holds the strong back to the form panel. On the other hand, when the depth of the strong back is too large, the conventional clamp is difficult to close, especially if the lumber is hard (e.g., where there is a knot in the lumber). Likewise, different concrete jobs can require different size strong backs be used (e.g., 2×6 lumber). Thus, conventional clamps only work consistently with conventional size strong backs. A need therefore exists to provide a clamp that can be adjusted to secure strong backs of various depths.

In addition, a clamp must be functional under working conditions that include splattering concrete. Thus, a need exists to provide a clamp will not be easily obstructed. Furthermore, it is desirable to provide a clamp that can be attached by a single worker, possibly using a single hand. Therefore, needs exist to provide a clamp that will not fall out of position before the worker can connect it, and a clamp that will not slip with respect to the strong back as it is being tightened.

Finally, many concrete contractors already have a set of conventional tie lock tools and conventional clamps for use with concrete form systems, and only want to supplement their existing equipment or replace broken hardware. Therefore, yet another need exists to provide a tie lock tool and a clamp that can be used with conventional concrete form systems and existing hardware.

Support apparatuses for concrete form systems have been used in the past, including the following:

| Inventor | U.S. Pat. No. | Issue Date |
|---|---|---|
| Gates | 3,908,956 | Sep. 30, 1975 |
| Gates | 4,158,452 | Jun. 19, 1979 |
| Gates | 4,304,388 | Dec. 8, 1981 |
| Gates | 4,899,978 | Feb. 13, 1990 |
| Page | 5,110,083 | May 5, 1992 |

U.S. Pat. No. 3,908,956 relates to a free-standing upwardly-convergent pouring form that is held in place by tie members and anchor members. Opposite ends of the tie members are releasably connected to their respective panels with latches.

U.S. Pat. No. 4,158,452 teaches a clamping lock for use with a looped tie in a concrete form. An anchor lock having a tapered claw is mounted on the clamping lock so that its claw can enter into a tie loop to secure the tie to the clamping lock and to tension the tie.

U.S. Pat. No. 4,304,388 discloses a form tie lock tool having a lock member for use with hand-set concrete panels and an anchor lock member for use with gang form concrete panels. An alternative embodiment discloses using a form tie having a button head with a modified tie lock tool 104 having a double claw arrangement (e.g., FIGS. 10–13).

U.S. Pat. No. 4,899,978 discloses a form tie lock that is releasably locked in an open position and swings over center to a closed position.

U.S. Pat. No. 5,110,083 discloses a Ross Staging Bracket that holds sections of forming walling in parallel rows. A rotatable lock means for engaging with a form tie is pivotally mounted to and beneath a first horizontal waler support plate.

None of the above patents provide a solution to the above-stated needs.

SUMMARY OF THE INVENTION

1. Solution to the Problem

The present invention solves the needs set forth above by providing a support apparatus having a tie lock tool and an adjustable clamp for use with a concrete form system.

The tie lock tool of the present invention has a lock member rotatable between an unlocked position and a locked position. The lock member has a first claw and a second claw that are radially coexistent and spaced from one another. In addition, the tie lock tool has a form tie opening configured to receive either a loop head or a button head. These features permit use of a form tie having either a loop head or a button head with the tie lock tool of the present invention.

The first claw of the tie lock tool of the present invention has an extension beyond the second claw. Thus, when the lock member is in the unlocked position and the head of the form tie is inserted through the form panel, the head abuts the extension of the first claw, automatically aligning the head so that it can be grasped and firmly held by the lock member as it is rotated to the locked position. That is, the extension automatically aligns the loop head so that it is held only by the second claw, whereas the button head is automatically aligned by the extension so that it is held by both claws.

When concrete is poured between the form panels of the support apparatus it exerts substantial force through the form tie onto the claws. In order to buttress the second claw, radius rest bars are disposed on the tie lock tool to offset the load on the second claw. For the same reason, the first claw is made thicker than the second claw, so that the first claw effectively bears the load when a button head is used. Additional strength is also provided by using a minimum height rivet to attach the lock member of the present invention, to the tie lock tool, thus reducing the bending moment of the rivet.

The support apparatus also comprises a clamp for securing a strong back of variable depth to the concrete form system. The clamp secures the strong back to the form system by attaching to the tie lock tool. The clamp has two arms that are loosely fit to a clamp member. Each arm is spreadable only within a plane parallel to the clamp member so as to fit onto the tie lock tool without falling out of position with respect to the tie lock tool when the arms are fitted onto the tie lock tool. In addition, the arms are manufactured to provide greater strength and durability than the 3-gauge wire of conventional clamps in order to bear a larger load when concrete is poured.

The clamp member of the clamp of the present invention is adjustable. That is, the clamp member comprises an engagement surface that tightens against the strong back so that strong backs of various depths can be securely clamped to the tie lock tool. In a preferred embodiment, the clamp member comprises an adjustable rod, and a block threaded therethrough. The rod is adjustable using a rope thread, thus providing an inexpensive, yet durable manner with which to adjust the clamp of the present invention. In addition, a centering point disposed on the engagement surface of the rod fixedly guides the rod against the strong back so that the engagement surface does not slip as it is tightened against the strong back. The rod is threaded using a conventional rope thread (e.g., having the threads widely spaced from one another) to reduce the effect of obstructions, such as splattered concrete, on the adjustability of the rod.

Finally, the tie lock tool and the clamp of the present invention are interchangeable with conventionally available support apparatus hardware (e.g., form panels, form ties, and strong backs). In addition, the adjustable clamp or tie lock tool of the present invention can be used with the conventional tie lock tool or clamp disclosed in co-owned U.S. Pat. No. 4,304,388.

2. Summary

The present invention comprises a support apparatus for use with a concrete form system. The concrete form system conventionally has opposing form panels. Each form panel has a first side, a second side, and at least one panel opening therethrough. The form panels are held in fixed relation to one another, with the second sides in a facing relation, by at least one form tie. A head is disposed on one end of the form tie and extends through the panel opening substantially perpendicular beyond the first side of the form panel. The head is preferably either a loop head or a button head.

A waler is positioned on the first side of the form panel adjacent to the panel opening. A tie lock tool engages the waler and attaches to the form tie. The tie lock tool has a bracket member that abuts the waler. The bracket member comprises a plate with a first end and a second end. A first flange is disposed in a perpendicular orientation on the first end of the plate and abuts the first side of the form panel. A form tie opening is formed at the first end of the plate and extends into the plate and into the first flange, and is configured to receive the head of the form tie, whether it is a loop head or a button head. A second flange disposed on the second end of the plate extends in a direction opposite and substantially parallel to the first flange to abut the waler.

A lock member is rotatably attached to the bracket member, preferably to the plate, and is rotatable between an unlocked position and a locked position. A first claw and a second claw are spaced in radial coexistance from each other on the lock member. The first claw has an extension beyond the second claw. Thus, when the head of the form tie extends through the form tie opening, the head abuts the extension of said first claw when the lock member is in the unlocked position. This automatically aligns the head of the form tie with the claws. When the lock member is thereafter rotated to the locked position, the head is guided onto and firmly held by the lock member so that the head of the form tie is secured to the tie lock tool, the waler, and the form panel, thus supporting the concrete form system.

In a preferred embodiment, radius rest bars are disposed on the bracket member between the plate and the first flange to reduce the load on the second claw. The first claw is formed sufficiently thick to withstand the load when a button head is used. The tie lock tool further has knobs disposed on opposing sides of the bracket member adjacent to the second flange. Each knob has a hooked end, so that a clamp can be attached to the tie lock tool.

A strong back of variable depth abuts the second flange portion of the tie lock tool between the knobs and is secured to the tie lock tool with an adjustable clamp. The clamp comprises a clamp member, which preferably has a block with a rod hole formed therein, and a rod engaging the rod hole. An arm is fitted on each of two shoulders, oppositely disposed on the block, so that the movement of the arms is restricted within a plane parallel to the rod. Connectors on each of the arms opposite the shoulders are attached to the hooked ends of the knobs. The rod has an engagement surface disposed on one end. A handle on the opposite end of the rod is used to move the rod through the rod hole until the engagement surface tightens against the strong back, irregardless of the actual depth of the strong back. Thus, the strong back is secured to the tie lock tool to support the concrete form system.

These and other advantages, features, and objects of the present invention will be more readily understood in view of the following detailed description and the drawings.

BRIEF DESCRIPTION OF THE DRAWINGS

FIGS. 3*a*, 3*b*, and 3*c* show a top view, side view, and front view, respectively, of a lock member of the present invention.

FIG. 4*a* shows a top view of a tie lock tool of the present invention in the unlocked position with a form tie having a loop head.

FIG. 4*b* is a front view of the tie lock tool of FIG. 4*a*.

FIG. 4*c* shows a top view of the tie lock tool of FIG. 4*a* in the locked position.

DETAILED DESCRIPTION OF THE INVENTION

1. Overview

Concrete form systems are conventionally used to build concrete walls. Generally, a concrete form system has opposing form panels held in fixed relation to one another by form ties. The concrete form system is assembled using a support apparatus having a waler and a tie lock tool adjacent to the waler that attaches to the form tie. Optionally, a strong back can be secured with a clamp to the form panels, for additional support and alignment of the concrete form system.

Figure 1:
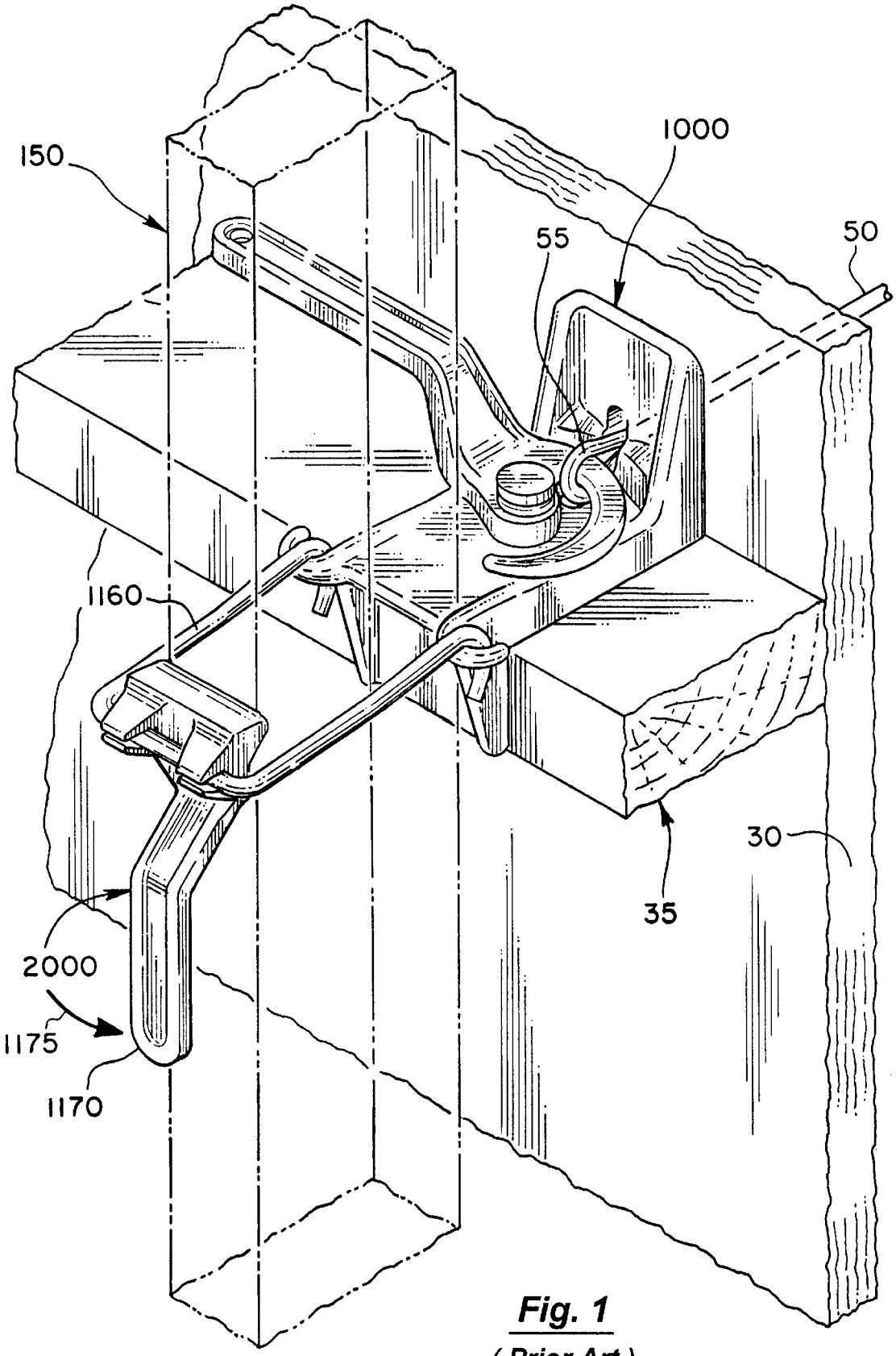
Fig. 1 ( Prior Art )
FIG. 1 is a perspective view of a prior art tie lock tool and a prior art clamp for use with concrete form panels.

FIG. 1 shows a tie lock tool 1000 of a prior art support apparatus. A form tie 50 extends between opposing form panels 30 (only one of which is shown) to hold the form panels 30 in fixed relation to one another. The form tie 50 is secured to the form panel 30 by locking the tie lock tool 1000 onto a loop head 55 of the form tie 50. While locking onto the form tie 50, the tie lock tool 1000 also secures a waler 35 to the form panel 30. Alternatively, the waler 35 can be secured to the form panel 30 by conventional attachment devices such as screws, nails, glue, or any other suitable attachment devices.

FIG. 1 also shows a strong back 150 used to further support and align the form panel 30. The strong back 150 is generally placed perpendicular to the waler 35 and secured to the tie lock tool 1000 using a clamp 2000. The clamp 2000 has a wire yoke 1160, typically 3-gauge wire, that is fitted around the strong back 150 and connected to the tie lock tool 1000. The handle portion 1170 of the clamp 2000 rotates in the direction of arrow 1175 and presses the strong back 150 against the tie lock tool 1000, thus securing the strong back 150 to the tie lock tool 1000.

Form panels 30 are conventionally made from sheet plywood, and the waler 35 and the strong back 150 are typically "two-by-four" (2×4) lumber. However, the material used to make the form panel 30, the waler 35, and strong back 150 is immaterial to the prior art and the present invention, and either or both the form panel 30 and the waler 35 could be made from steel, wood, a plastic such as polyurethane, or any other suitable material that provides the requisite strength for supporting concrete poured between the two form panels 30. In addition, form panels 30 can be of any desired dimension and typically require more than one tie lock tool 1000 to support the form panels 30. Likewise, the form tie 50 is conventionally made of steel, but other materials that provide the requisite strength can be used.

Figure 2A:
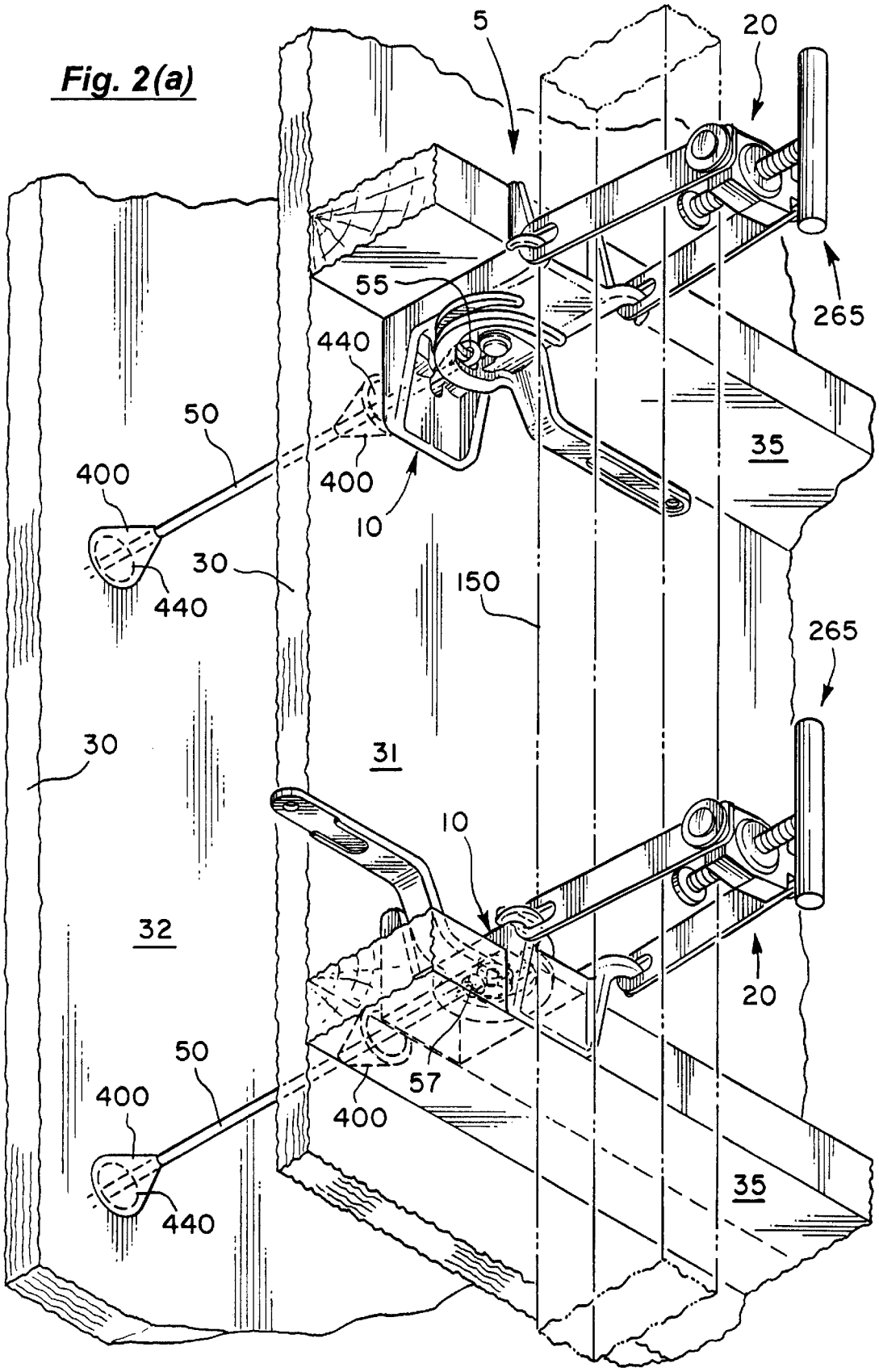
FIG. 2*a* is a perspective view of the support apparatus of the present invention in use with a concrete form panel.

FIG. 2*a* shows a support apparatus 5 of the present invention. The support apparatus 5 can be used with a conventional concrete form system, as described above and as shown in FIG. 2*a*, having at least a form panel 30 and a form tie 50. Preferably, opposing form panels 30 having a first side 31 and a second side 32 are positioned so that the second sides 32 are in a facing relationship to one another. Form panels 30 are fixedly positioned by the form ties 50 extending therebetween. Panel openings 440 are formed within the form panels 30. As before, a waler 35 is positioned on the first side 31 of the form panel 30 adjacent to a panel opening 440 in the form panel 30. The head 55, 57 of the form tie 50 extends through the panel opening 440. In addition to the form panel 30 and the waler 35, the support apparatus 5 preferably comprises a tie lock tool 10, a clamp 20, and a strong back 150.

In a preferred embodiment, the tie lock tool 10 engages the waler 35 to secure the waler 35 to the form panel 30. However, as discussed above, the waler 35 can be secured to the form panel 30 either with the tie lock tool 10 or with other suitable attachment devices. In a preferred embodiment, each tie lock tool 10 is placed underneath the waler 35 except for the lowermost tie lock tool 10, which is positioned above the lowermost waler 35, as shown in FIG. 2*a*. However, it is to be expressly understood that the tie lock tool 10 can be positioned in any orientation. Indeed, the walers 35 can be positioned vertically, so that the tie lock tool 10 is placed beside (as opposed to over or under) the waler 35. Likewise, the form panels 30 need not be arranged in opposing relation to one another. For example, a single form panel 30 can be used in conjunction with a form tie 50 secured to an existing structure (e.g., to widen an existing wall).

Figure 2B:
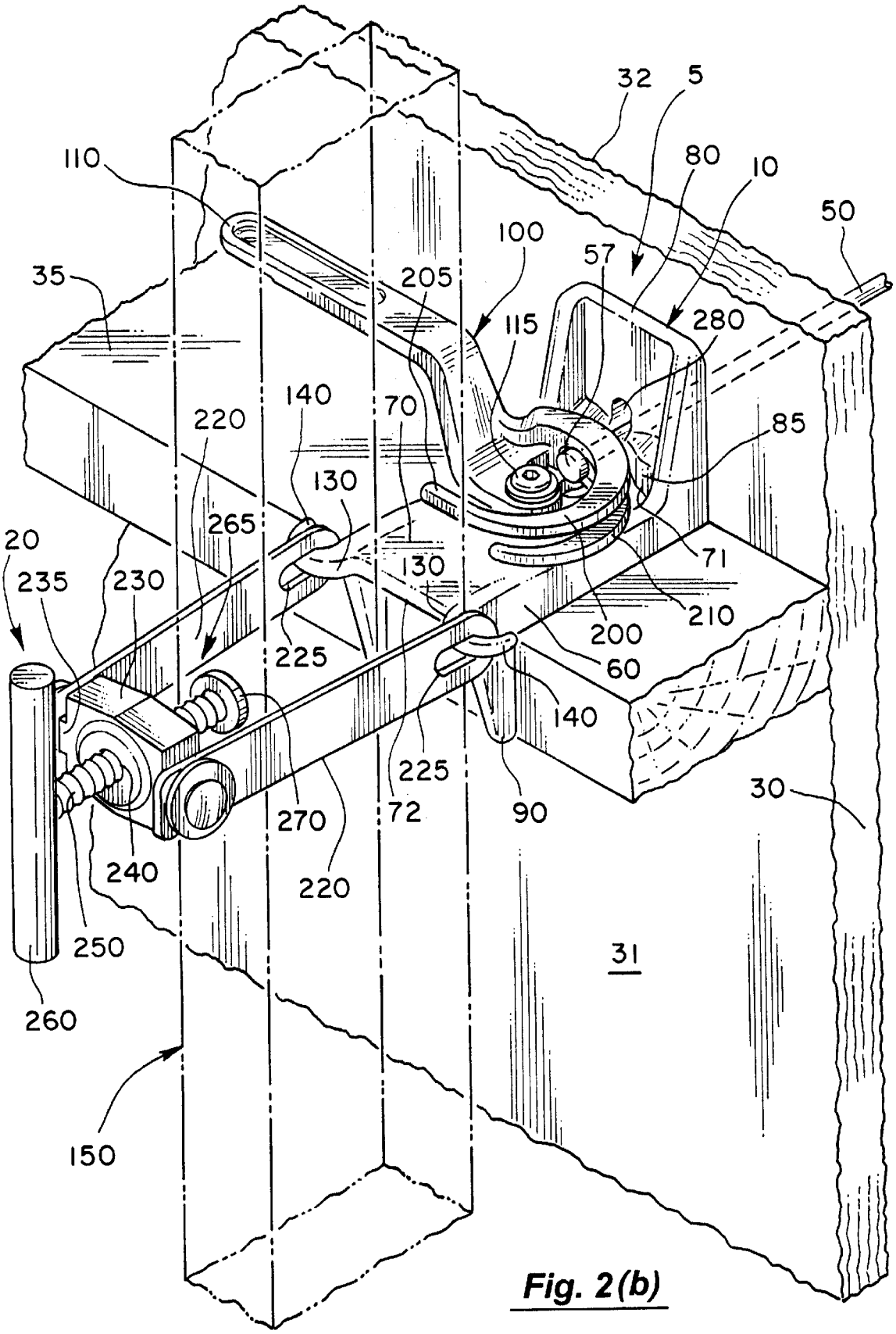
FIG. 2*b* is a perspective view of the tie lock tool and the clamp of the support apparatus of FIG. 2*a*.

FIG. 2*b* illustrates the support apparatus 5 of the present invention in greater detail. The support apparatus 5 preferably comprises a tie lock tool 10 and a clamp 20. The tie lock tool 10 engages the waler 35. The tie lock tool 10 has a bracket member 60 that abuts the form panel 30 and the waler 35. A lock member 100 is pivotally disposed on the bracket member 60. The lock member 100 has a handle portion 110 attached to a first claw 200 and a second claw 210. The first claw 200 and the second claw 210 are preferably spaced from one another and radially coextensive. The two claws 200, 210 enable the tie lock tool 10 of the present invention to be used with a form tie 50 having either a loop head 55, as shown in FIG. 2*a*, or a button head 57, as shown in FIG. 2*b*. The first claw 200 has an extension 205 extending beyond the second claw 210. The extension 205 acts as a guide for aligning the head 55, 57 of the form tie 50 with the lock member 100, thus reducing the time and labor required to align the head 55, 57 with the lock member 100, as discussed in more detail below with respect to FIGS. 4–7.

FIG. 2*b* also shows the clamp 20 of the support apparatus 5 of the present invention. The clamp 20 has a clamp member 265 to which two arms 220 are attached. A strong back 150 is placed abutting the bracket member 60 of the tie lock tool 10. The arms 220 are placed around strong back 150 and connected to the tie lock tool 10 using connectors 225. The clamp member 265 is then adjusted until an engagement surface 270 contacts the strong back 150. The clamp member 265 is then tightened against the strong back 150 to secure the strong back 150 to the tie lock tool 10 and to support the concrete form system, as discussed more fully below with respect to FIGS. 8 and 9.

An important feature of the tie lock tool 10 and the clamp 20 of the present invention is the interchangeability of hardware. The tie lock tool 10 of the present invention can be used with either the clamp 20 of the present invention or a conventional clamp 2000. Likewise, the clamp 20 of the present invention can be used with either the tie lock tool 10 of the present invention, or with a conventional tie lock tool 1000. Furthermore, the tie lock tool 10 and the clamp 20 of the present invention can be used side by side with conventional hardware on a single concrete form system.

2. Details of the Tie Lock Tool 10

The tie lock tool 10 secures the form tie 50 and the waler 35 to the form panel 30 of the concrete form system as shown in FIG. 2*b*. The bracket member 60 of the tie lock tool 10 has a plate 70 that abuts the waler 35. The plate 70 has a first end 71 and a second end 72. A first flange 80 is attached in a perpendicular orientation to the plate 70 at the first end 71. The first flange 80 abuts the first side 31 of the form panel 30. A second flange 90 is attached to the plate 70 in a direction opposite and substantially parallel to the first flange 80 at the second end 72. The second flange 90 abuts the waler 35.

In a preferred embodiment, the plate 70, first flange 80, and second flange 90 are cast as a single bracket member 60. However, it is to be understood that the plate 70, first flange 80, and second flange 90 can be cast separately and assembled to form the bracket member 60. Likewise, the second flange 90 can be formed into two prongs as shown in FIG. 2*b*, or can be a solid plate (not illustrated). In either case, the second flange 90 is substantially parallel to the first flange 80. In other words, the second flange 90 is preferably assembled at ninety degrees to plate 70 and parallel to the first flange 80, or the second flange 90 can be slanted slightly toward plate 70 so that it pulls the waler 35 toward the form panel 30, and tensions the form tie 50, when the tie lock tool 10 is locked, as more fully described below. In another embodiment, not illustrated, the first flange 80 is attached or cast at a preset angle relative to the plate 70, for example, when one or even both faces of the concrete wall are to have a facial slope of sixty degrees. In such an embodiment, the first flange 80 is positioned at sixty degrees with respect to plate 70, and the second flange 90 would therefore be perpendicular to the plate 70 instead of parallel to the first flange 80. In yet another embodiment (not shown), for example, in which the waler 35 is attached by an attachment device as described above, the bracket member 60 does not include second flange 90 at all.

In a preferred embodiment, two knobs 130 are disposed on opposing sides of the second end 72 of the bracket member 60, as shown in FIG. 2*b*. The knobs 130 each have a hooked end 140 formed thereon for attaching to connectors 225 of a clamp 20.

Preferably, the knobs 130 and hooked ends 140 are cast as an integral part of the bracket member 60. However, it is to be expressly understood that the hooked ends 140 can be cast separately and then attached to the bracket member 60. The knobs 130 and the hooked ends 140 can be positioned on the second flange 90, rather than the second end 72.

In the preferred embodiment shown in FIG. 2*b*, the clamp 20 is attached to the tie lock tool 10 when the connectors 225 fit over the hooks 140. However, it is to be expressly understood that any type of connection system can be used so long as it enables the clamp 20 to be firmly attached to the tie lock tool 10. For example (not shown), a locking device can be formed within the second flange, perhaps having a rod therein that the clamp 20 connects to. Other methods of attaching the clamp 20 to the tie lock tool 10 will be evident to those skilled in the art, and the present invention is not meant to be limited by the particular description given herein. Indeed, in circumstances in which a clamp 20 is not connected to the tie lock tool 10, the tie lock tool 10 need not have any knobs 130 or hooked ends 140.

In a first preferred embodiment shown in FIG. 2*b* and more clearly in FIGS. 5 and 7, a form tie opening 280 is formed within the bracket member 60. Preferably, the form tie opening 280 extends from the first flange 80 into the plate 70, as shown in FIGS. 5 and 7. The form tie opening 280 is configured to receive the head 55, 57 of the form tie 50. That is, preferably a first portion 281 of form tie opening 280 within the first flange 80 is narrow, and a second portion 282 of the form tie opening 280 within the plate is sufficiently wide to receive a button head 57 therethrough.

Figure 5A:
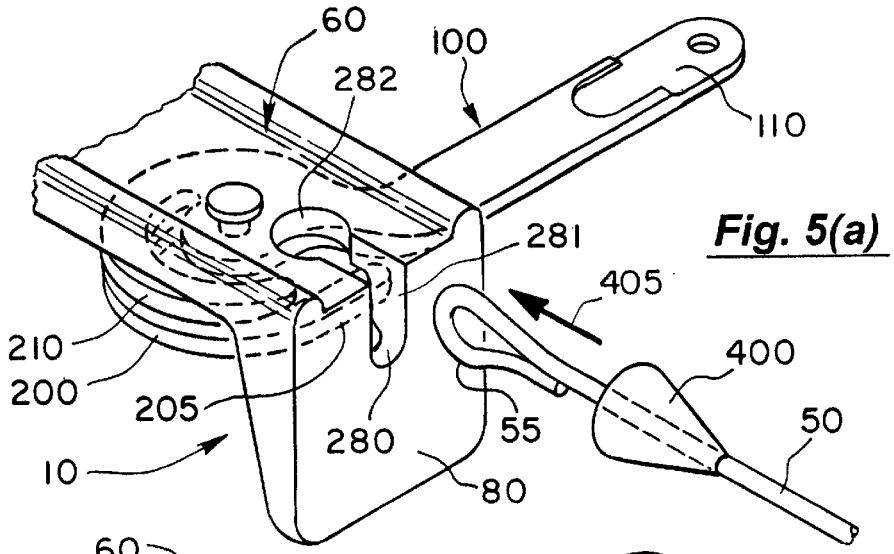
FIGS. 5*a* and 5*b* illustrate a perspective view of a tie lock tool of the present invention with the tie lock member in the unlocked position, and the insertion of a form tie having a loop head.
Figure 5B:
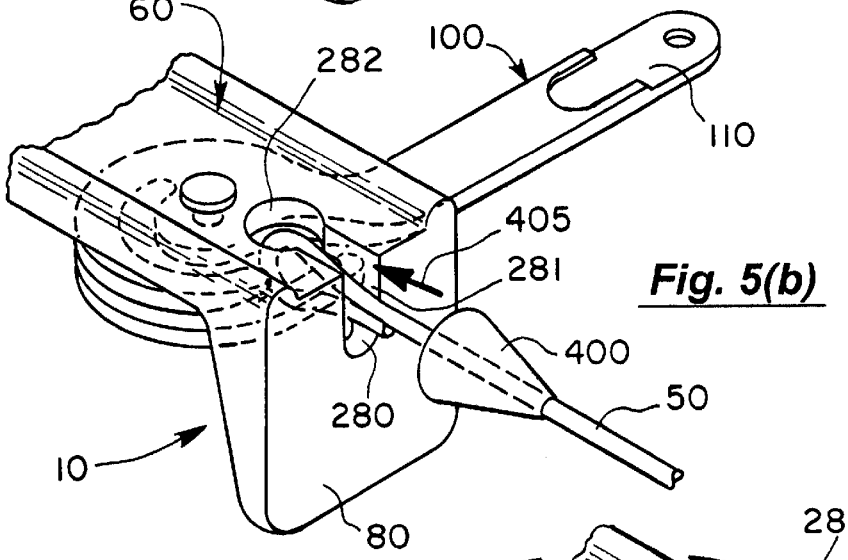
Figure 7A:
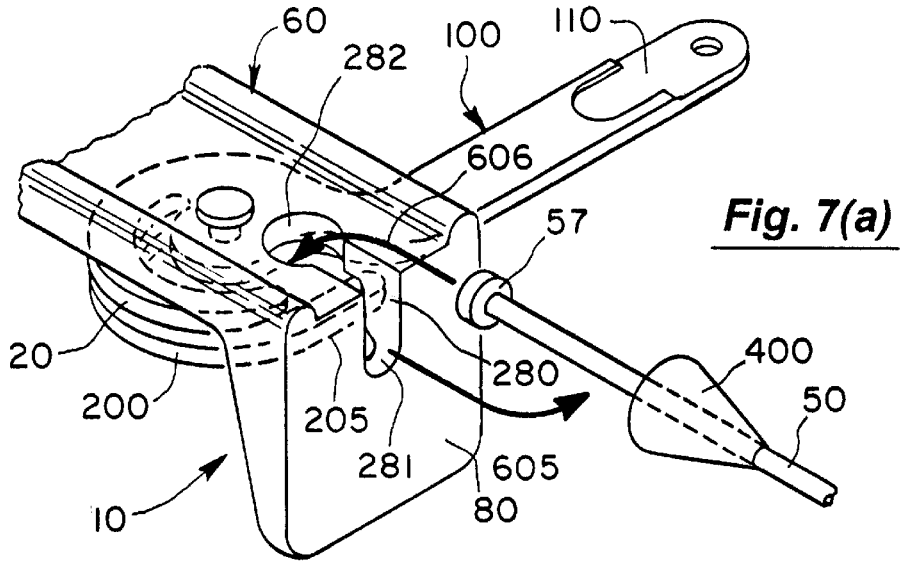
FIGS. 7*a* and 7*b* illustrate a perspective view of a tie lock tool of the present invention with the tie lock member in the unlocked position, and the insertion of a form tie having a button head
Figure 7B:
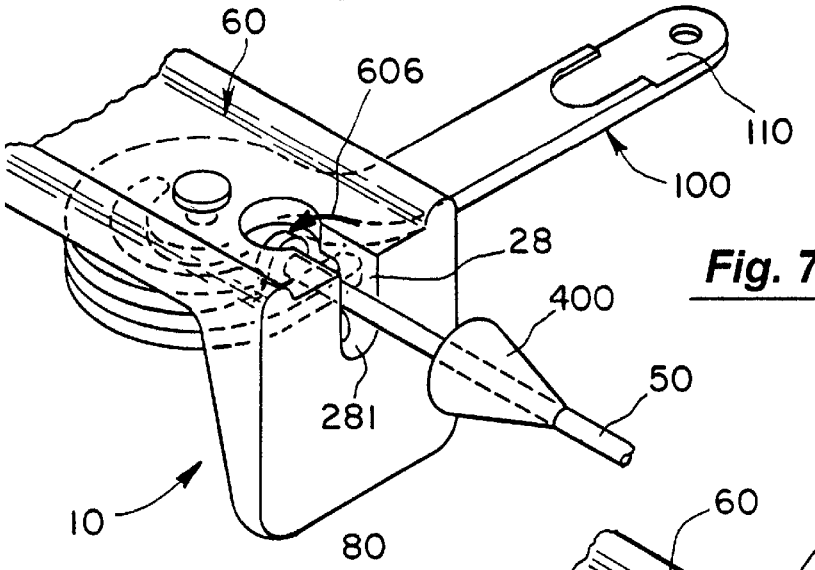

A loop head 55 is generally no wider than the form tie 50, so that a form tie 50 having a loop head 55 can be placed entirely through the narrow, or first portion 281 of the form tie opening 280 formed within the first flange 80, as shown in FIGS. 5*a* and 5*b*. However, the button head 57 is generally wider than the form tie 50. Thus, the second portion 282 of the form tie opening 280 formed within the plate 70 of bracket member 60 is preferably more widely configured to accept the button head 57 therethrough, as shown in FIGS. 7*a* and 7*b*. Thus, with this configuration of the opening 280, the tie lock tool 10 can accept both the loop head 55 and the button head 57. The first (narrow) portion 281 of the form tie opening 280 formed within the first flange 80 also serves to hold the form tie 50 in place during the rotation of the lock member 100, as described in greater detail below.

In a second embodiment (not shown), the form tie opening 280 is a single opening within only the first flange 80 of the bracket member 60. In this embodiment, the form tie opening 280 is preferably configured to accept the largest head 55, 57 that is used with the tie lock tool 10. For example, if only the loop head 55 is used with the tie lock tool 10, the form tie opening 280 can be narrowly configured. However, when the button head 57, or other wide head, is used with the tie lock tool 10, the form tie opening 280 must be configured sufficiently large to accept the button head 57 therethrough (e.g., see FIG. 7). A form tie opening 280 configured under this embodiment to receive the button head 57 is also configured to receive the loop head It is to be expressly understood that the form tie opening 280 of the present invention can be configured to accept different shaped heads of the form tie 50. For example, the head can be J-shaped, L-shaped, T-shaped, spherical, pyramidal, or any other or suitable shape so long as it can be securely grasped by either one or both of the claws 200, 210 of the present invention.

FIGS. 3*a*, 3*b*, and 3*c* show the lock member 100 of the tie lock tool 10 of the present invention. A handle 110 is disposed on the lock member 100. The handle 110 can be attached in any suitable fashion (e.g., like a ratchet, or even detachable), so long as it serves to rotate the lock member 100 about the bracket member 60. Indeed, in another embodiment (not shown), the handle 110 can be dispensed with if the lock member 100 is rotated without the handle 110.

In a preferred embodiment, the lock member 110 is attached at a pivot 115 with a rivet made from malleable or ductile casting so that the height of the rivet head is held to a minimum. As such, the bending moment of the pivot 115 is reduced and the lock member 100 is more resistant to loads placed on the pivot 1 15 with respect to the bracket member 60. However, the lock member 100 can be attached to the bracket member 60 at the pivot 115 using a conventional rivet, a screw, a pin, or any other suitable connection device that permits the lock member 100 to rotate between the unlocked and locked positions.

The lock member 100 supports two radially formed claws 200, 210. The first claw 200 and the second claw 210 are spaced apart from one another in a radially coexisting manner so as to form a gap therebetween.

The first claw 200 has a substantially rectangular cross section, radiused sufficiently for casting. The rectangular cross section provides a solid surface for securely holding the button head 57 in place. The second claw 210, however, is formed to grasp either the loop head 55 or the button head 57. Therefore, the second claw 210 has a substantially tear drop-shaped cross section to allow it to readily fit through the loop head 55 of the form tie 50, while still providing a requisite surface for supporting a button head 57. In addition, the second claw 210 has a narrowed tip that assists in guiding the second claw 210 through the loop head 57. However, it is to be expressly understood that the claws 200 and 210 can be, for example, oval or circular in cross section, and need not be narrowed at the tip.

The first claw 200 has an extension 205 of its end beyond the end of the second claw 210. The extension 205 of the first claw 200 is best shown in FIGS. 3*a* and 3*b*. The extension 205 is formed on the end of the first claw 200 and preferably extends parallel to the handle 110. The extension 205 extends beyond the second claw 210 for a length sufficient to act as a guide when the lock member 100 is rotated from an unlocked position to a locked position, as discussed more fully below with reference to FIGS. 4 through 7. It is to be expressly understood that the extension 205 can extend in a direction other than parallel to the handle 110. For example, in another embodiment (not shown), the extension 205 extends radially beyond the second claw 210.

Operation of the tie lock tool 10 to secure the loop head 55 of the form tie 50 can be seen in FIGS. 4 and 5, where FIG. 5 shows the tie lock tool 60 in reverse orientation from FIG. 4. In a first embodiment, shown in FIGS. 4*a* and 4*b*, the loop head 55 is inserted through the panel opening 440 in the form panel 30. The waler 35 is positioned adjacent the panel opening 440 and then the bracket member 60, with the lock member 100 in the unlocked position, is placed to abut the waler 35 and the form panel 30. As the bracket member 60 is thus positioned, the loop head 55 is received in the direction of arrow 605 (shown for the button head 57 in FIG. 7) through the second portion 282 of the form tie opening 280 in the plate 70 of the bracket member 60 so that the form tie 50 extends in the direction of arrow 606 (shown for the button head 57 in FIG. 7) through the first portion 281 of the form tie opening 280 in the first flange 80 to abut the extension 205 of the first claw 200 as shown in FIGS. 4*b* and 5*b*. In other words, the form tie 50 is pre-positioned through the panel opening 440 so that the loop head 55 extends substantially perpendicularly beyond the first side 31 of the form panel 30. Then the bracket member 60 is positioned over the loop head 55 so that the head 55 abuts the extension 205 of the first claw 200.

In a second embodiment, the bracket member 60 is first positioned to abut the waler 35 and the form panel 30 as described above, so that the form tie opening 280 is aligned with the panel opening 440, as shown in FIG. 2*a*. The lock member 100 is rotated with the handle 110 to an unlocked position, shown in FIGS. 4*a* and 5*a*. The loop head 55 is then extended 405 through the panel opening 440 and the form tie opening 280 to abut the extension 205 of the first claw 200 as shown in FIGS. 4*b* and 5*b*. In other words, the bracket member 60 is pre-positioned abutting the waler 35 and then the loop head 55 is inserted through the first portion 281 of the form tie opening 280 formed within the first flange 80.

Figure 5C:
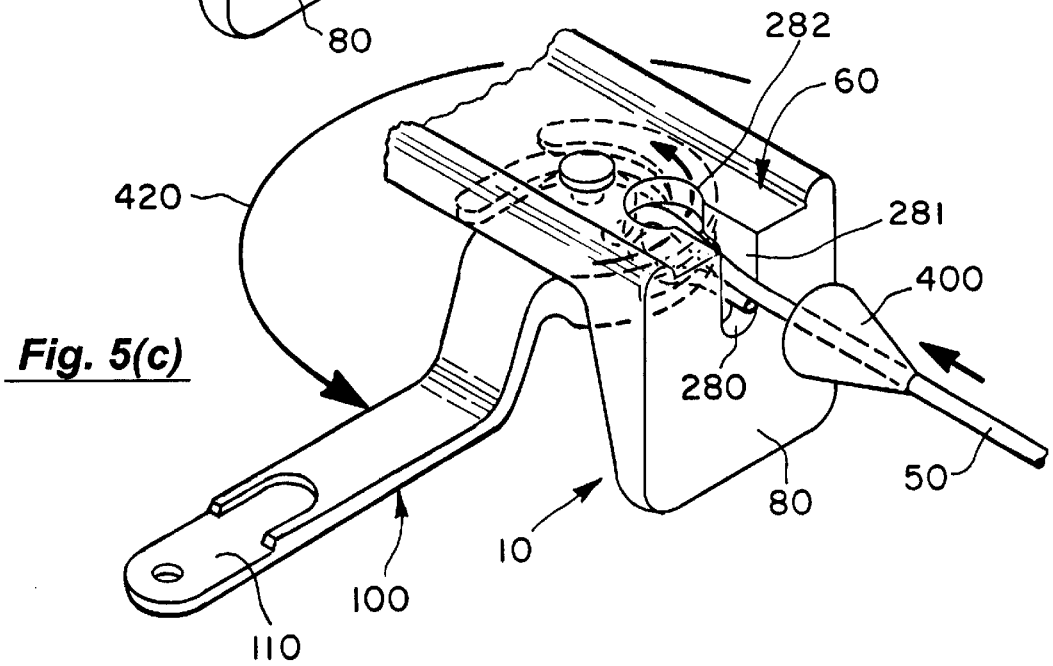
FIG. 5*c* shows a perspective view of the lock member of FIG. 5*a* in the locked position.

In both embodiments, the form tie 50 abuts the extension 205 of the first claw 200 after the head 55, 57 is received through the form tie opening 280, as described above. The lock member 100 is then rotated 420, as illustrated in FIGS. 4*c* and 5*c*, so that the second claw 210 extends through the loop head 55 of the form tie 50 (e.g., in the direction of arrow 425). The extension 205 acts as a guide, positioning and holding the loop head 55 so that it is in the correct position for the second claw 210 as the lock member 100 is rotated in the direction of arrow 420 to the locked position shown in FIG. 4*c*. Once the lock member 100 is in the locked position, as shown in FIGS. 4*c* and 5*c*, the form tie 50 is secured to the tie lock tool 10. This action also secures the tie lock tool 10 to the waler 35 and the form panel 30, and secures the waler 35 to the form panel 30.

Figure 6A:
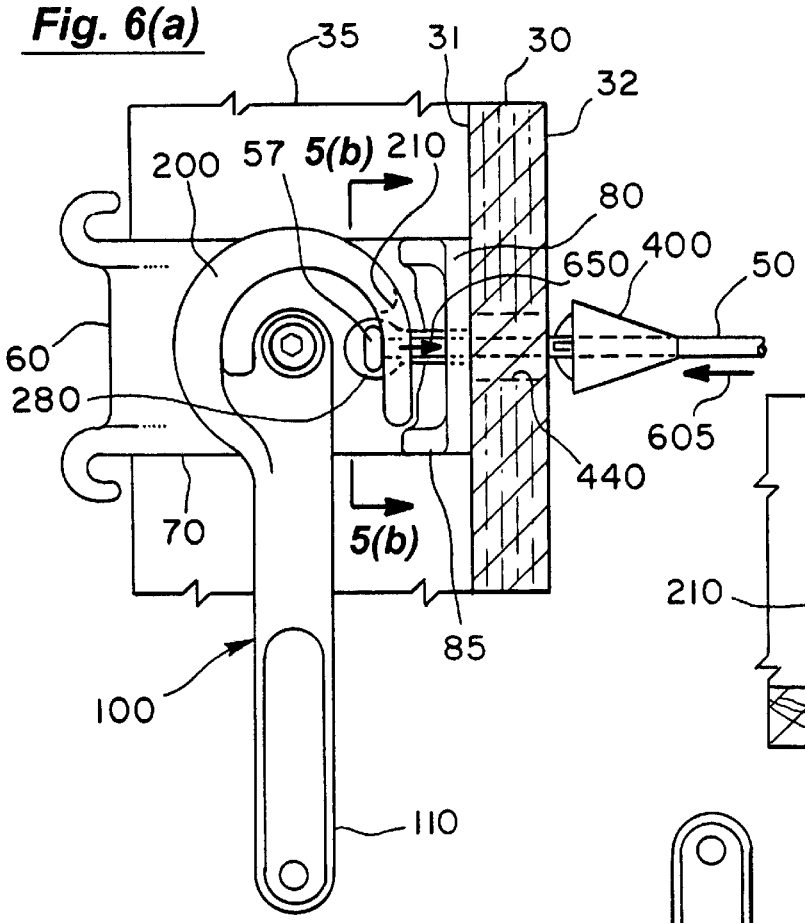
FIG. 6*a* shows a top view of a tie lock tool of the present invention in the unlocked position with a form tie having a button head.
Figure 6B:
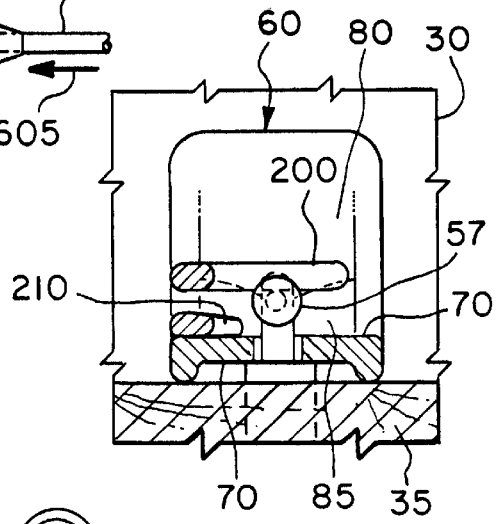
FIG. 6*b* is a front view of the tie lock tool of FIG. 6*a*.

Operation of the tie lock tool 10 to secure a form tie 50 having a button head 57 is shown in FIGS. 6 and 7, where FIG. 7 shows the tie lock tool 10 in reverse orientation from FIG. 6. The lock member 100 is rotated to an unlocked position, shown in FIGS. 6*a* and 7*a*. However, unlike the loop head 55 which can extend through the first portion 281 of the form tie opening 280 in the first flange after the tie lock tool is positioned on the waler 35 (i.e., the second embodiment), the button head 57 must first be positioned through the form panel 30 before the bracket member 60 is positioned on the waler 35 (i.e., the first embodiment). In other words, when the button head 57 is used with the tie lock tool 10, the button head 57 must first be extended through the form panel opening 440 so that the button head 57 extends substantially perpendicular beyond the first side 31 of the form panel 30. The bracket member 60 is then positioned on the waler 35 so that the second portion 282 of the form tie opening 280 receives the button head 57, as shown by arrow 606 in FIG. 7*a*. As described above, the second portion 282 of the form tie opening 280 is configured to receive such a button head 57 in this preferred embodiment. The form tie 50 abuts the extension 205 of the first claw 200 after the button head 57 is received through the form tie opening 280, as described above.

Figure 6C:
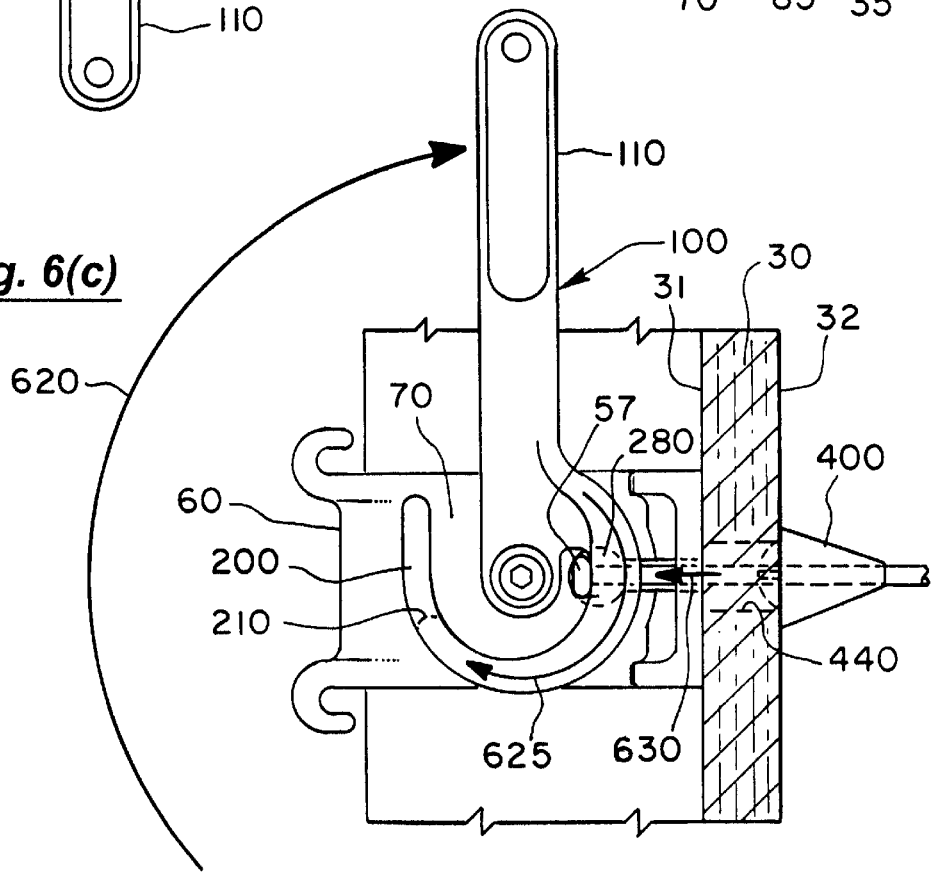
FIG. 6*c* shows a top view of the tie lock tool of FIG. 6*a* in the locked position.
Figure 7C:
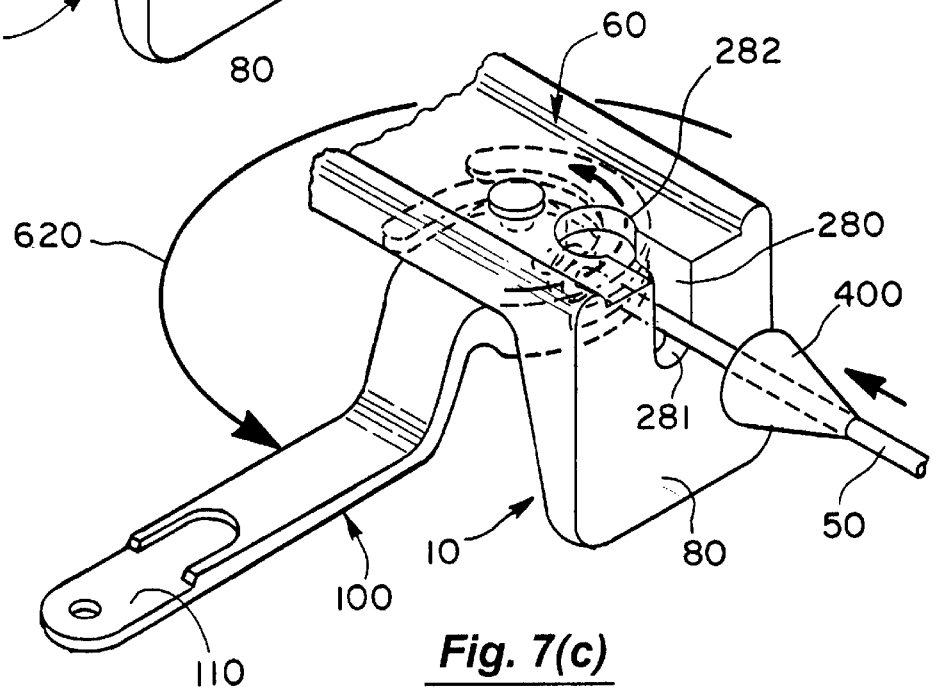
FIG. 7*c* shows a perspective view of the lock member of FIG. 7*a* in the locked position.

After the tie lock tool 10 is positioned as just described, the lock member 100 is rotated 620, 625 as illustrated in FIGS. 6*c* and 7*c* so that the button head 57 is positively seated between the first claw 200 and the second claw 210. The extension 205 acts as a guide, as discussed above with respect to the loop head 55, positioning and holding the button head 57 so that it is in the correct position to be positively seated between the claws 200, 210 as the lock member 100 is rotated in the direction of arrow 620 to the locked position shown in FIG. 6*c*. Once the lock member 100 is in the locked position, as shown in FIGS. 6*c* and 7*c*, the form tie 50 is secured to the tie lock tool 10. This action also secures the tie lock tool 10 to the waler 35 and the form panel 30, and secures the waler 35 to the form panel 30.

Thus, a single tie lock tool 10 of the present invention can be used to secure a form tie 50 having a loop head 55 or having a button head 57. In addition, the extension 205 of the first claw 200 acts as a guide, automatically aligning the head 55, 57 with the lock member 100, so that a single worker, possibly using just one hand, can quickly operate the tie lock tool 10 of the present invention.

In a preferred embodiment, the form tie 50 having either a loop head 55 or a button head 57 extends perpendicular to the form panel 30, or approximately at ninety degrees to the form panel 30. However, the opposing form panel 30, or the panel opening 440 in the opposing form panel 30, to which the form tie 50 extends, can be offset so that the form tie 50 extends between the opposing form panels 30 at an angle other than ninety degrees.

In a preferred embodiment, the lock member 100 acts as a cam. Both of the claws 200, 210 are shaped progressively thicker from their ends, as shown in FIG. 3*a*, to act as a cam when the lock member 100 is rotated between the unlocked and locked position. As such, the head 55, 57 is pulled through the form panel opening 440 and tensioned as the lock member 100 is rotated 420, 620 from the unlocked position to the locked position. In addition, the cam action of the lock member 100 serves to secure the tie lock tool 10 against the waler 35, and thus secure the waler 35 to the form panel 30 without the use of the attachment devices discussed above. However, the lock member 100 need not act as a cam. In an embodiment in which the lock member 100 does not act as a cam, the claws 200 and 210 still hold the head 55, 57 of the form tie 50 in place, but do not tension the form tie 50.

A stopper 400 is available for use with the form tie 50. As the lock member 100 rotates 420, 620 to the locked position, as shown in FIGS. 4*c* and 6*c*, the stopper 400 is seated against the second side 32 of the form panel 30 (as shown in FIG. 2*a*) and assists in tensioning the form tie 50 against the form panel 30. Thus, the stopper 400 is useful in concrete jobs requiring large expanses of form panels 30 to securely hold the form panels 30 in position while additional form panels 30 of the concrete form system are assembled. The stopper 400 is conventional and is generally a plastic cone removably attached to the form tie 50. However, the stopper 400 can take any suitable form, such as, for example, a block, a clip, or a bend in the form tie 50 itself, and can be made from any suitable material. Indeed, in some embodiments, the stopper 400 is not needed. For example, the stopper 400 need not be used with concrete form systems comprised of only a short expanse of form panels 30, or where the concrete is poured as the form panels 30 are assembled and hence the poured concrete itself serves to tension the form panels 30.

Optionally, a radius rest bar 85 (as shown in FIGS. 2*b*, 4, and 6) is positioned between the plate 70 and the first flange 80 on either side of the form tie opening 280. As concrete is poured between the form panels of the support apparatus 5, a substantial force 450, 650 is exerted by the form tie 50 on the claws 200, 210. The radius rest bars 85 provide a surface to buttress the second claw 210, and thus offset the load on the second claw 210. For the same reason, the first claw 200 is made thicker than the second claw 210, so that the first claw 200 effectively bears the load 650 when the button head 57 is used.

The radius rest bars 85 can be cast as part of the bracket member 60, or cast separately and attached to the bracket member 60. Likewise, if the first flange 80 and plate 70 are cast separately, the radius rest bars 85 can also be cast as part of the plate 70 or as part of the first flange 80. In addition, the radius rest bars 85 can be extended to also support the first claw 200.

3. Details of the Clamp 20

Figure 8A:
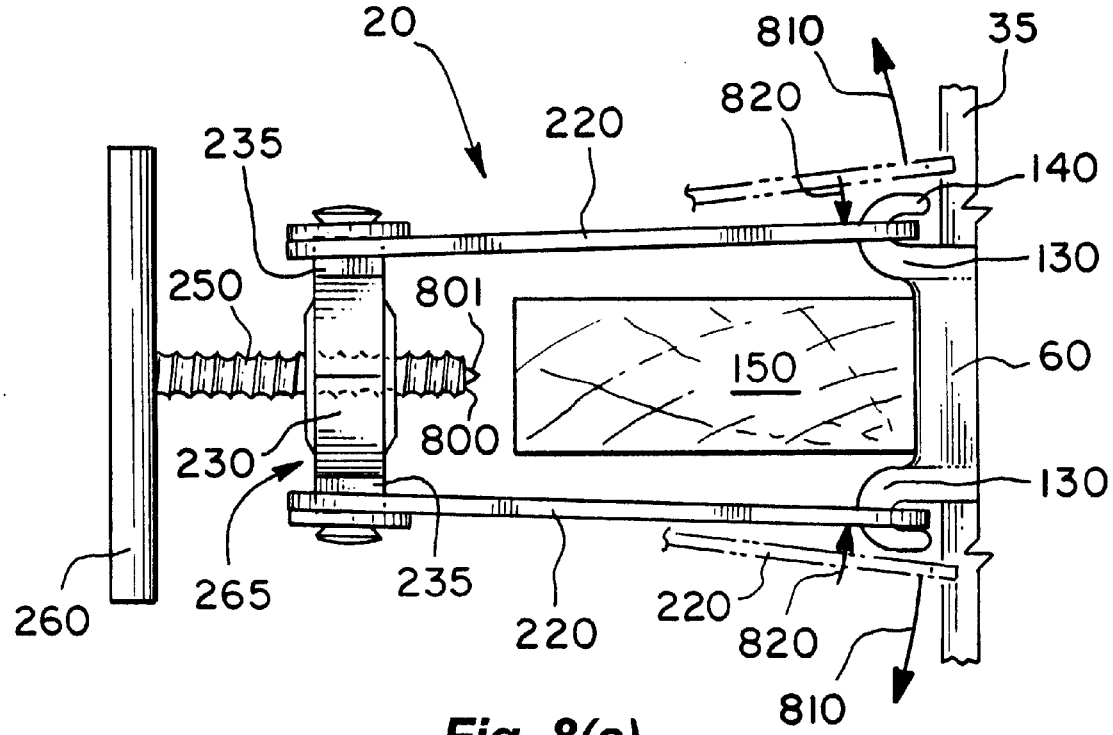
FIG. 8*a* shows a top view of a clamp of the present invention in an unlocked position.
Figure 8B:
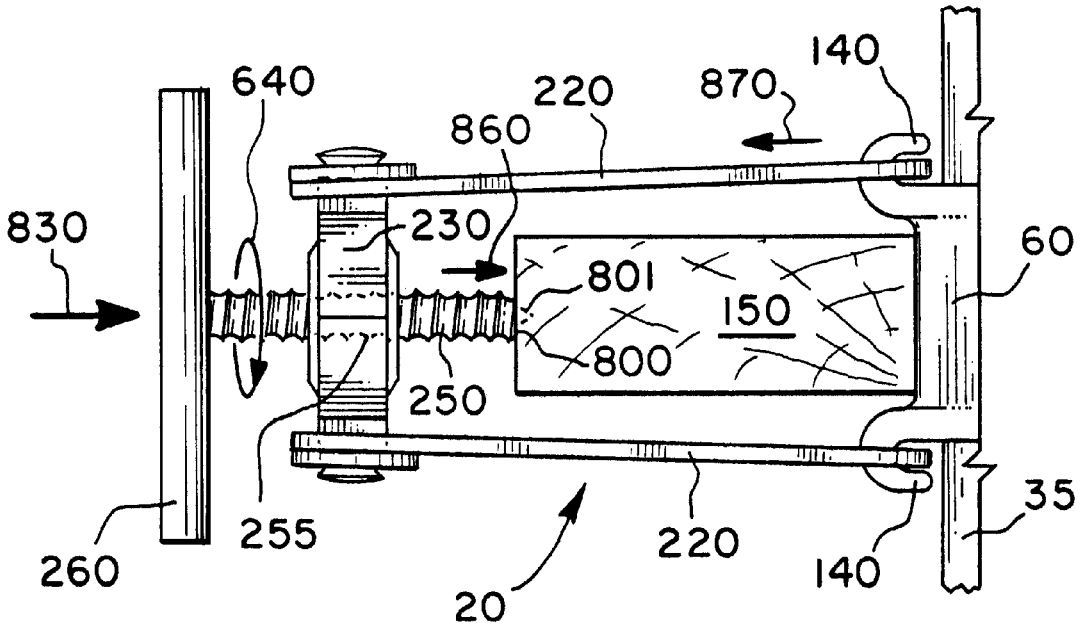
FIG. 8*b* shows the clamp of FIG. 8*a* in a locked position.

The support apparatus 5 of the present invention also includes a clamp 20. The clamp 20 is used to affix a strong back 150 to the concrete form system to strengthen and align the form panels 30. FIG. 8 shows a preferred embodiment of the clamp 20 of the present invention. The clamp 20 has a moveable clamp member 265. An arm 220 is loosely attached to each side of the moveable clamp member 265 to fit around the strong back 150 abutting the bracket member 60 of the tie lock tool 10. To attach the clamp 20 to the tie lock tool 10, the arms 220 are spread outward (i.e., in the direction of arrow 810) to fit over the hooked end 140 on each of the knobs 130 of the bracket member 60. Once positioned over the knobs 130, the arms 220 are pushed inward (i.e., in the direction of arrow 820) so that connectors 225 on each of the arms 220 opposite the clamp member 265 (see FIG. 2*b*) attach to the hooked ends 140 of the tie lock tool 10. The arms 220 of the clamp 20 are thus removably attached to the tie lock tool 10. The clamp member 265 is then moved until an engagement surface 800, disposed on the clamp member 265, tightens against the strong back 150. This exerts a force in the direction of arrow 870 against the hooked ends 140, while simultaneously exerting an opposing force in the direction of arrow 860 against the strong back 150. In this manner, the clamp 20 secures the strong back 150 to the tie lock tool 10.

In a preferred embodiment, the clamp member 265 comprises a block 230, a rod 250, and a handle 260. The block 230 is preferably made from a die-cast aluminum alloy that is very strong and very workable. The block 230 has a shoulder 235 disposed on opposite sides of the block 230. The shoulders 235 are preferably molded as part of the block 230 and support the arms 220 on the block 230 so that the arms 220 are moveable only in a plane parallel to the rod 250.

The shape of the shoulders 235 is immaterial to the present invention. In a preferred embodiment, the shoulders 235 serve to hold the arms 220 in fixed relation to the rod 250, while allowing restricted movement in a plane parallel to the rod so that the arms 220 can be spread to fit over the hooked ends 140 of the tie lock tool 10. Thus, when the clamp 20 is placed about the strong back 150, the arms 220 remain in position (i.e., they remain aligned with the knobs 130 on the tie lock tool 10) and are readily positioned over the hooked ends 140 of the tie lock tool 10. Therefore, the shoulders 235 can be any suitable design that will allow the arms 220 to be fitted to the block 230 while their movement is restricted as described above.

In this preferred embodiment, a rod hole 255 is threaded through the block 230 to engage the rod 250 movably therethrough. Both the rod hole 255 and the rod 250 are preferably threaded using a "rope" thread (i.e., each thread is widely spaced from the adjacent thread). The wide spacing of the "rope" thread provides a durable thread that is less likely to plug or otherwise become obstructed by splattered concrete.

The handle 260 is attached to one end of the rod 250 and rotated in the direction of arrow 640 to move the rod 250 in the direction of arrow 830 until an engagement surface 800 of the rod 250 is tightened against the strong back 150. In a preferred embodiment, the engagement surface 800 is a pointed tip 801 formed on the end of the rod 250. The pointed tip 801 catches on the surface of the strong back 150 as the reengagement surface 800 first touches the strong back 150 surface, and fixedly guides the rod 250 onto the strong back 150 as the rod 250 tightens against the strong back 150. The pointed tip thus prevents the rod 250 from "walking" (e.g., sliding on the strong back 150 surface or slipping out of place) as the rod 50 is moved against the strong back 150. Although in this preferred embodiment, the engagement surface 800 is a pointed tip, other embodiments are contemplated by the present invention, for example a threaded tip (e.g., a screw tip), a flat cap (e.g., cap 270 shown in FIG. 2*b*), a pointed cap, a cap with a pointed tip disposed thereon, a rounded surface, or simply flat end of the surface of the rod 250. Other embodiments will be evident to those skilled in the art, and the present invention is not meant to be limited by the description herein.

Other preferred embodiments of the clamp 20 are contemplated under the teachings of the present invention. The arms 220 can be curved (not shown). In other words, the arms 220 are attached to the block 230, but then curve outward from the block 230 so that the arms 220 can be placed around strong backs 150 having a width greater than the width of the block 230. In this embodiment, the clamp 20 can be used to secure strong backs 150 of different widths. It is also important to the present invention, that the clamp 20 can secure a strong back 150 of various depths, as discussed below in reference to FIG. 9. For example, a finer thread can be used on the rod 250 and the rod hole 255. Or the rod 250 can slide through block 230 and lock in place with a cotter pin or ratchet device. Indeed, the block 230, the shoulder 235, and the arm 220 assembly of the clamp 20 can be cast as a single unit (not illustrated), wherein the arms 220 are sufficiently elastic so as to fit over the hooked ends 140 of the tie lock tool 10. The arms 220 can be directly attached (e.g., with screws, or a weld) to the block 230. Alternatively, a single U-shaped arm can be used, thus eliminating the need for the block 230 and the shoulder 235 altogether. Similarly, the handle 260 does need not be permanently affixed to the rod 250, and can be removable. Alternatively, the handle can act as a ratchet, gripping the rod 250 as it is moved in one direction, and releasing the rod 250 as it is moved in the opposite direction. Or the handle 260 can be entirely replaced with a slot on the end of the rod 250, so that the slot is engageable with a screwdriver or other device suitable for turning the rod 250. In addition, the connectors 225 can be holes formed within arms 220 as shown in FIG. 2*b*, or can be open ended, like hooks, so that the arms 220 need not be spread apart (e.g., in the direction of arrow 810) to fit over the knobs 130 of the tie lock tool 10. Any suitable connector, including hinged latch members similar to those used on fence gates, could also be used, as will be evident to those skilled in the art.

Furthermore, it is to be expressly understood the clamp member 265 can be a cam assembly (not shown), wherein a cam is pivoted about an axis connecting the arms 220 to one another. As the cam is rotated about the connecting axis, it progressively tightens against the strong back 150. The cam be turned an amount sufficient to tighten the strong back 150 against the tie lock member 10. However, unlike the prior art device shown in FIG. 1, which has two positions (unlocked and closed), the cam could be infinitely adjusted to seat the clamp 20 against strong backs 150 of various depths.

Figure 9A:
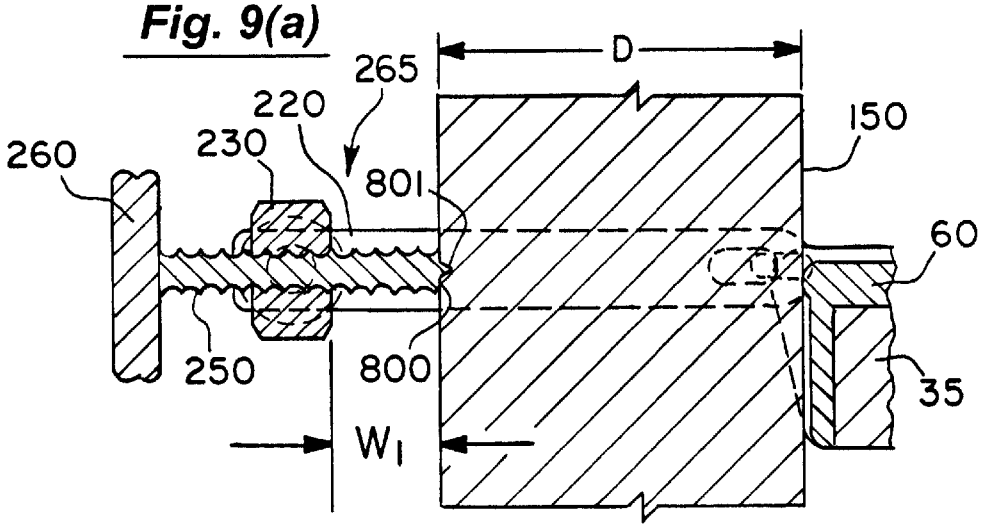
FIGS. 9*a*, 9*b*, and 9*c* are cross section views of a clamp of the present invention securing strong backs of various depths to a tie lock tool.
Figure 9B:
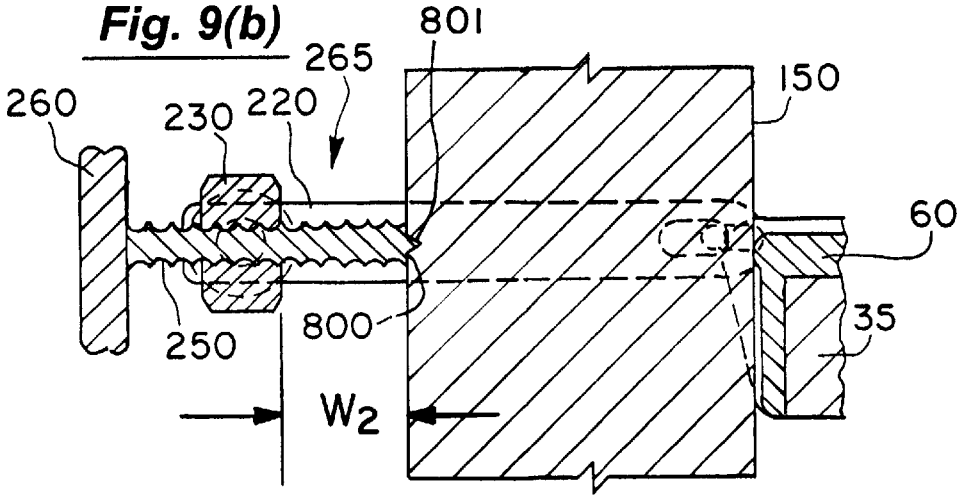
Figure 9C:
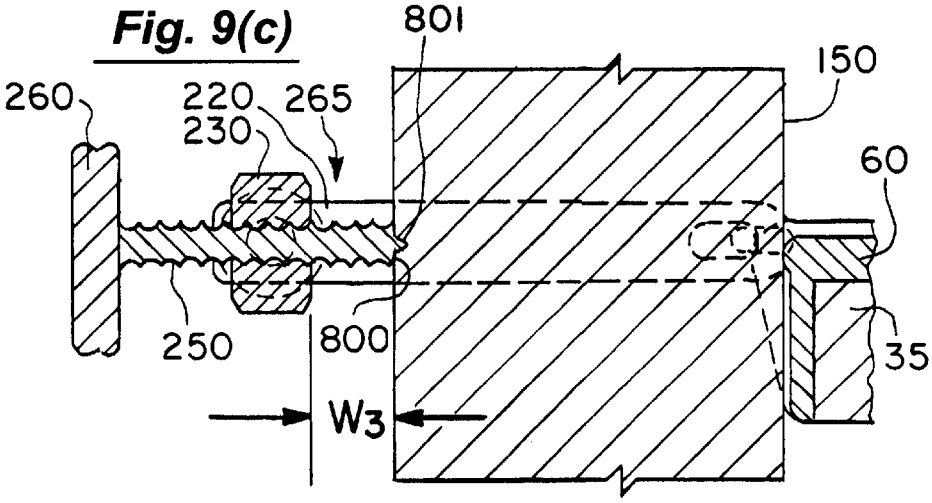

FIGS. 9*a*, 9*b*, and 9*c* show cross-sectional views of the clamp 20 of the present invention securing strong backs 150 of various depths to a tie lock tool 10. A conventional 2×4 strong back (1½ inches wide by 3½ inches deep d) is shown in FIG. 9*a*. The clamp member 265 is tightened (e.g., a distance of $W_1$) until the engagement surface 800 seats the strong back 150 securely to the tie lock tool 10.

However, 2×4 lumber can vary in depth so that the strong back 150 is either smaller (FIG. 9*b*) or bigger (FIG. 9*c*) than a strong back 150 made from a conventional 2×4. Because the clamp member 265 of the clamp 20 of the present invention is adjustable, the same clamp 20 can be used to securely seat a strong back 150 of any depth d. When the strong back 150 is smaller than a conventional 2×4, the clamp member 265 is tightened a distance of $W_2$, as shown in FIG. 9*b*, and when the strong back 150 is larger than a conventional 2×4, the clamp member 265 is tightened a distance of $W_3$, as shown in FIG. 9*c*.

Tolerances of 2×4 lumber can be substantial. Likewise, strong backs 150 made from other lumber sizes (e.g., 2×6) can also be used with the clamp 20 of the present invention. Therefore, the clamp 20 of the present invention is not limited to variations of standard 2×4 lumber and can be designed to fit any size strong back 150.

A support apparatus 5, having a tie lock tool 10 and a clamp 20, for use with a concrete form system has been disclosed herein. Concrete form systems conventionally have a form panel 30 secured using a form tie 50. A head 55, 57 of the form tie 50 extends through the form panel 30 and is engaged by the tie lock tool 10 positioned against the form panel 30 and a waler 35. The tie lock tool 10 has a lock member 100 rotatably attached to a bracket member 60. The bracket member 60 has a form tie opening 280 configured therein to receive the head 55, 57 of the form tie 50. The lock member 100 has a first claw 200 and a second claw 210 spaced from one another. In addition, the first claw has an extension 205 that extends beyond the second claw 210. Thus, when the lock member 100 is in an unlocked position, the head 55, 57 is extended through the form tie opening 280 in bracket member 60 to abut the extension 205. The head 55, 57 is firmly held by the lock member 100 as the lock member 100 is rotated to a locked position. Hence, the head 55, 57 of the form tie 50 is secured to the tie lock tool 10, the waler 35, and the form panel 30 to support the concrete form system. Additionally, an adjustable clamp 20 is used to secure a strong back 150 of variable depth to the tie lock tool 10. An arm 220 is loosely attached on each side of a clamp member 265. The clamp 20 is attached to the tie lock tool 10 with connectors 225 on each arm 220. The clamp member 265 is then moved until an engagement surface 800 tightens against the strong back 150, thus securing the strong back 150 of variable depth to the tie lock tool 10 to support the concrete form system.

The foregoing discussion of the invention has been presented for purposes of illustration and description. Further, the description is not intended to limit the invention to the form disclosed herein. Consequently, variation and modification commensurate with the above teachings, within the skill and knowledge of the relevant art, are within the scope of the present invention. The embodiment described herein and above is further intended to explain the best mode presently known of practicing the invention and to enable others skilled in the art to utilize the invention as such, or in other embodiments, and with the various modifications required by their particular application or uses of the invention. It is intended that the appended claims be construed to include alternate embodiments to the extent permitted by the prior art.

I claim:

1. A support apparatus for use with a concrete form system, said concrete form system having at least a form panel and a form tie, said form panel having a first side and a panel opening formed therein, said support apparatus comprising:

a head on one end of said form tie, said head extending through said panel opening, said head extending substantially perpendicular beyond said first side of said form panel, wherein said head is selected from the group consisting of a loop head and a button head;

a waler positioned on said first side of said form panel adjacent to said panel opening;

a tie lock tool engaging said waler, said tie lock tool comprising:

a bracket member abutting said waler and said first side of said form panel, said bracket member having a form tie opening configured to receive said head formed within said bracket member, said bracket member further comprising:

a plate abutting said waler, said plate having a first end and a second end;

a first flange disposed in a perpendicular orientation on said first end of said plate, said first flange abutting said first side of said form panel, wherein said form tie opening is formed at said first end of said plate, said form tie opening extending into said plate and into said first flange; and a second flange disposed on said second end of said plate extending in a direction opposite and substantially parallel to said first flange, said second flange abutting said waler;

a lock member rotatably attached to said bracket member, said lock member rotatable between an unlocked position and a locked position;

a first claw and a second claw spaced from each other on said lock member, said first claw having an extension beyond said second claw, said head extending through said form tie opening and abutting said extension of said first claw when said lock member is in said unlocked position, said head firmly held by said lock member when said lock member is rotated to said locked position so that said head of said form tie is secured to said tie lock tool, said waler, and said form panel to support said concrete form system, wherein said first claw has a substantially rectangular-shaped cross section and said second claw has a substantially tear drop-shaped cross section, and wherein said first claw and said second claw are shaped progressively thicker so that said lock member acts as a cam; and hooked ends disposed on opposing sides of said bracket member;

a strong back, said strong back abutting said bracket member of said tie lock tool between said hooked ends;

a clamp adjustable to secure said strong back to said tie lock tool, said clamp comprising:

a clamp member;

an arm loosely attached on each side of said clamp member, said arms moveable so that said arms fit onto said tie lock tool;

connectors on each of said arms opposite said clamp member, said connectors removably attaching to said hooked ends of said tie lock tool;

an engagement surface disposed on said clamp member, said clamp member moveable until said engagement surface tightens against said strong back, thereby securing said strong back to said tie lock tool to support said concrete form system, radius rest bars disposed on said bracket member of said tie lock tool;

wherein said clamp member further comprises:

a block having a rod hole formed therethrough;

an adjustable rod engaging said rod hole, said engagement surface disposed on the end of said adjustable rod, said engagement surface being pointed for fixedly guiding said clamp member against said strong back.

2. The support apparatus of claim 1, wherein said arms are moveable only within a plane parallel to said clamp member when said clamp member is in a secured position, so that said arms fit onto said tie lock tool.

3. A tie lock tool for securing a form tie and a waler to a form panel, said form panel having a first side and a panel opening formed therein, a head of said form tie extending through said panel opening beyond said first side of said form panel, said tie lock tool comprising:

a plate abutting said waler, said plate having a first end and a second end;

a first flange disposed in a perpendicular orientation on said first end of said plate, said first flange abutting said first side of said form panel, said first end of said plate having a form tie opening formed therein and extending into said plate and into said first flange, said form tie opening configured to receive said head of said form tie, said head selected from the group consisting of a loop head and a button head;

a second flange disposed on said second end of said plate extending in a direction opposite and substantially parallel to said first flange, said second flange abutting said waler;

a lock member rotatably attached to said plate, said lock member rotatable between an unlocked position and a locked position, said lock member having a first claw and a second claw spaced from each other, said first claw having an extension beyond said second claw, said head extending through said form tie opening and abutting said extension of said first claw when said lock member is in said unlocked position so as to positively seat said head in said lock member, said head firmly held by said lock member when said lock member is rotated to said locked position so that said head of said form tie is secured to said tie lock tool and said tie lock tool is secured to said waler and to said form panel.

4. The tie lock tool of claim 3, wherein said first claw and said second claw are shaped progressively thicker so that said lock member acts as a cam.

5. The tie lock tool of claim 3, further comprising radius rest bars disposed on said first flange of said tie lock tool.

6. A clamp adjustable to secure a strong back to a tie lock tool, said clamp comprising:

a block having a rod hole formed therein;

a rod engaging said rod hole;

an arm loosely attached on each of opposing sides of said block, said arms moveable only within a plane parallel to said rod;

connectors on each of said arms opposite said block;

an engagement surface disposed on the end of said rod, said rod moveable through said rod hole.

7. The clamp of claim 6, wherein said engagement surface is pointed.

8. The clamp of claim 6, further comprising a handle for moving said rod through said block.

9. A clamp adjustable to secure a strong back to a tie lock tool, said clamp comprising:

a block having a rod hole formed therein;

a threaded rod engaging said rod hole;

two shoulders oppositely disposed on said block;

an arm loosely attached on each of said two shoulders, said arms moveable only within a plane parallel to said rod;

connectors on each of said arms opposite said shoulders, said connectors removably attaching to said tie lock tool;

an engagement surface disposed on the end of said rod; and a handle disposed on said threaded rod opposite said engagement surface for moving said threaded rod through said rod hole until said engagement surface tightens against said strong back, wherein said engagement surface is pointed.

10. A support apparatus for use with a concrete form system, said concrete form system having at least a form panel and a form tie, said form panel having a first side and a panel opening formed therein, said support apparatus comprising:

a head on one end of said form tie, said head extending through said panel opening, said head extending substantially perpendicular beyond said first side of said form panel, said head selected from the group consisting of a loop head and a button head;

a waler positioned on said first side of said form panel adjacent said panel opening;

a tie lock tool engaging said waler, said tie lock tool comprising:

a bracket member abutting said waler and said first side of said form panel, said bracket member having a form tie opening configured to receive said head formed within said bracket member;

a lock member rotatably attached to said bracket member, said lock member rotatable between an unlocked position and a locked position;

a first claw and a second claw spaced from each other on said lock member, said first claw having an extension beyond said second claw, said head extending through said form tie opening and abutting said extension of said first claw when said lock member is in said unlocked position, said head firmly held by said lock member when said lock member is rotated to said locked position so that said head of said form tie is secured to said tie lock tool, said waler and said form panel to support said concrete form system; and knobs disposed on said bracket member, each of said knobs having a hooked end;

a strong back, said strong back abutting said bracket member of said tie lock tool between said knobs; and a clamp adjustable to secure said strong back to said tie lock tool, said clamp comprising:

a block having a rod hole formed therein;

an arm loosely attached on each of opposing sides of said block;

connectors on each of said arms opposite said block, said connectors attaching to said hooked ends of said knobs;

a rod engaging said rod hole;

an engagement surface disposed on the end of said rod, said rod moveable through said rod hole until said engagement surface tightens against said strong back, thereby securing said strong back to said tie lock tool to support said concrete form system.

11. The support apparatus of claim 10, wherein said arms are moveable only within a plane parallel to said rod so that said arms fit onto said tie lock tool.

12. The support apparatus of claim 10, wherein said bracket member further comprises:

a plate abutting said waler, said plate having a first end and a second end;

a first flange disposed in a perpendicular orientation on said first end of said plate, said first flange abutting said first side of said form panel;

a second flange disposed on said second end of said plate extending in a direction opposite and substantially parallel to said first flange, said second flange abutting said waler.

13. The support apparatus of claim 10 wherein said form tie opening is formed at said first end of said plate, said form tie opening extending into said plate and into said first flange.

14. The support apparatus of claim 10, wherein said first claw has a substantially rectangular-shaped cross section and said second claw has a substantially tear drop-shaped cross section .

15. The support apparatus of claim 10, further comprising radius rest bars disposed on said bracket member of said tie lock tool.

16. The support apparatus of claim 10, wherein said first claw and said second claw are shaped progressively thicker so that said lock member acts as a cam.

17. The support apparatus of claim 10, wherein said engagement surface is pointed for fixedly guiding said rod against said strong back.

18. A support apparatus for use with a concrete form system, said concrete form system having at least a form panel and a form tie, said form panel having a first side and a panel opening formed therein, said support apparatus comprising:

a head on one end of said form tie, said head extending through said panel opening, said head extending substantially perpendicular beyond said first side of said form panel, said head selected from the group consisting of a loop head and a button head;

a waler positioned on said first side of said form panel adjacent said panel opening;

a tie lock tool engaging said waler, said tie lock tool comprising:

a plate abutting said waler, said plate having a first end and a second end;

a first flange disposed in a perpendicular orientation on said first end of said plate, said first flange abutting said first side of said form panel, said first end of said plate having a form tie opening extending into said plate and into said first flange, said form tie opening configured to receive said head;

a second flange disposed on said second end of said plate extending in a direction opposite and substantially parallel to said first flange, said second flange abutting said waler;

a lock member rotatably attached to said plate, said lock member rotatable between an unlocked position and a locked position;

a first claw and a second claw spaced from each other on said lock member, said first claw having an extension beyond said second claw, said head extending through said form tie opening and abutting said extension of said first claw when said lock member is in said unlocked position, said head firmly held by said lock member when said lock member is rotated to said locked position so that said head of said form tie is secured to said tie lock tool, said waler and said form panel to support said concrete form system; and knobs disposed on opposing sides of said second flange, each of said knobs having a hooked end;

a strong back, said strong back abutting said second flange portion of said tie lock tool between said knobs; and a clamp adjustable to secure said strong back to said tie lock tool, said clamp comprising:

a block having a rod hole formed therein;

two shoulders oppositely disposed on said block;

an arm fitted on each of said two shoulders;

connectors on each of said arms opposite said shoulders, said connectors attaching to said hooked ends of said knobs;

a rod engaging said rod hole;

an engagement surface disposed on the end of said rod;

a handle disposed on said rod opposite said engagement surface for moving said rod through said rod hole until said engagement surface tightens against said strong back, thereby securing said strong back to said tie lock tool to support said concrete form system.

19. The support apparatus of claim 18, wherein said first claw has a substantially rectangular-shaped cross section and said second claw has a substantially tear drop-shaped cross section .

20. The support apparatus of claim 18, further comprising radius rest bars disposed on said first flange of said tie lock tool.

21. The support apparatus of claim 18, wherein said first claw and said second claw are shaped progressively thicker so that said lock member acts as a cam.

22. The support apparatus of claim 18, wherein said engagement surface is pointed for fixedly guiding said rod against said strong back.

23. The support apparatus of claim 18, wherein said arms are moveable substantially within a plane parallel to said rod so that said arms fit over said hooked ends of said knobs.

24. A tie lock tool for securing a form tie and a waler to a form panel, said form panel having a first side and a panel opening formed therein, a head of said form tie extending through said panel opening beyond said first side of said form panel, said tie lock tool comprising:

a bracket member abutting said waler and said first side of said form panel, said bracket member having a form tie opening configured to receive said head of said form tie formed within said bracket member;

a lock member rotatably attached to said bracket member, said lock member rotatable between an unlocked position and a locked position, said lock member having a first claw and a second claw spaced from each other, said first claw having an extension beyond said second claw, said head extending through said form tie opening and abutting said extension of said first claw when said lock member is in said unlocked position so as to positively seat said head in said lock member, said head firmly held by said lock member when said lock member is rotated to said locked position so that said head of said form tie is secured to said tie lock tool and said tie lock tool is secured to said waler and to said form panel.

25. The tie lock tool of claim 24, wherein said bracket member further comprises:

a plate abutting said waler, said plate having a first end and a second end;

a first flange disposed in a perpendicular orientation on said first end of said plate, said first flange abutting said first side of said form panel;

a second flange disposed on said second end of said plate extending in a direction opposite and substantially parallel to said first flange, said second flange abutting said waler.

26. The tie lock tool of claim 25 wherein said form tie opening is formed at said first end of said plate, said form tie opening extending into said plate and into said first flange, said form tie opening configured to receive said head of said form tie, said head selected from the group consisting of a loop head and a button head.

27. The tie lock tool of claim 24, wherein said first claw and said second claw are shaped progressively thicker so that said lock member acts as a cam.

28. The tie lock tool of claim 24, further comprising radius rest bars disposed on said first flange of said tie lock tool.

29. The tie lock tool of claim 24, wherein said first claw has a substantially rectangular-shaped cross section and said second claw has a substantially tear drop-shaped cross section.

* * * * *